US010839668B2

(12) United States Patent
Tezuka et al.

(10) Patent No.: US 10,839,668 B2
(45) Date of Patent: Nov. 17, 2020

(54) ALARM INFORMATION PROCESSING APPARATUS AND CONTROL PROGRAM FOR ALARM INFORMATION PROCESSING APPARATUS

(71) Applicant: NIHON KOHDEN CORPORATION, Shinjuku-ku, Tokyo (JP)

(72) Inventors: Shinji Tezuka, Tokorozawa (JP); Rie Muneshima, Tokorozawa (JP)

(73) Assignee: NIHON KOHDEN CORPORATION, Tokyo (JP)

( * ) Notice: Subject to any disclaimer, the term of this patent is extended or adjusted under 35 U.S.C. 154(b) by 0 days.

(21) Appl. No.: 16/508,984

(22) Filed: Jul. 11, 2019

(65) Prior Publication Data

US 2020/0027330 A1 Jan. 23, 2020

(30) Foreign Application Priority Data

Jul. 20, 2018 (JP) ..... 2018-137008

(51) Int. Cl.
*G08B 21/00* (2006.01)
*G08B 21/18* (2006.01)
*G08B 29/02* (2006.01)

(52) U.S. Cl.
CPC ..... *G08B 21/182* (2013.01); *G08B 29/02* (2013.01)

(58) Field of Classification Search
CPC ... G01M 17/027; G01R 21/133; G06Q 50/06; G08B 21/182; G08B 29/02; G08B 21/02; G08B 21/0211; G08B 43/26; E21B 47/00; F04B 17/05; F04B 2201/0402; F04B 2201/0404; F04B 47/02; F04B 51/00; F04B 53/18; F16N 29/00; G01N 33/2888; G05B 9/03; G21C 17/00; Y04S 10/54; Y10S 706/914
USPC ..... 340/501, 500, 531, 540, 573.1, 539.1, 340/539.11, 517, 524, 525, 6.1, 521–522, 340/505, 519
See application file for complete search history.

(56) References Cited

U.S. PATENT DOCUMENTS 4,972,453 A * 11/1990 Daniel, III ..... G06F 11/2257 379/9.02
5,467,074 A * 11/1995 Pedtke ..... G08B 25/009 340/514
5,812,622 A * 9/1998 Chang ..... G21D 3/00 376/259
5,892,440 A * 4/1999 Bryan ..... G05B 23/0267 340/524
5,923,731 A * 7/1999 McClure ..... H04M 11/04 340/506

(Continued)

FOREIGN PATENT DOCUMENTS

JP 5893822 B2 3/2016

*Primary Examiner* — Daniel Previl
(74) *Attorney, Agent, or Firm* — Pearne & Gordon LLP

(57) ABSTRACT

An alarm information processing apparatus includes: a setter that sets a threshold about alarm information; an accumulator that accumulates alarms occurring within a predetermined period of time; and a determiner that determines whether the alarm information accumulated by the accumulator exceeds the threshold set by the setter. In the apparatus, the setter sets a threshold about a number of times of occurrence of the alarms, as the threshold about the alarm information, and the accumulator accumulates the number of times of occurrence of the alarms as the alarm information.

15 Claims, 4 Drawing Sheets

(56) References Cited

U.S. PATENT DOCUMENTS

| | | | | |
|---|---|---|---|---|
| 2011/0080293 | A1* | 4/2011 | Tanishima | G16H 40/63<br>340/573.1 |
| 2018/0354134 | A1* | 12/2018 | Arita | B25J 9/1664 |

* cited by examiner

ALARM INFORMATION PROCESSING APPARATUS AND CONTROL PROGRAM FOR ALARM INFORMATION PROCESSING APPARATUS

CROSS REFERENCE TO RELATED APPLICATION

This application is based on Japanese Patent Application No. 2018-137008 filed on Jul. 20, 2018, the contents of which are incorporated herein by reference.

BACKGROUND

The presently disclosed subject matter relates to an alarm information processing apparatus and a control program for the alarm information processing apparatus.

Apparatuses which generate alarms upon detection of abnormality of vital sign of patients, trouble of measurement instruments etc., or the like have been used in medical sites.

Japanese Patent No. 5893822 discloses an apparatus which displays an alarm and a method for dealing with the alarm upon detection of such abnormality and trouble. A medical staff member such as a nurse may check the display and take a necessary measure.

However, in the technique described in Japanese Patent No. 5893822, an alarm occurs whenever such abnormality and trouble is detected. For this reason, when the abnormality is detected usually, the medical staff member has to respond to the usually occurring alarms, thereby resulting in a large burden on the medical staff member. Response to the usually occurring alarms may be more problematic particularly in a medical site, a time slot, etc. with a limited number of medical staff members who can respond.

The presently disclosed subject matter is to provide an alarm information processing apparatus and a control program for the alarm information processing apparatus which can improve an environment where alarms occur usually.

According to an aspect of the present disclosed subject matter, an alarm information processing apparatus includes:

a setter that sets a threshold about alarm information;

an accumulator that accumulates alarms occurring within a predetermined period of time; and a determiner that determines whether the alarm information accumulated by the accumulator exceeds the threshold set by the setter.

According to another aspect of the presently disclosed subject matter, an alarm information processing apparatus control method includes:

setting a threshold about alarm information;

accumulating alarms occurring within a predetermined period of time; and determining whether the alarm information accumulated in the accumulation step exceeds the threshold set in the setting step.

According to another aspect of the presently disclosed subject matter, an alarm information processing apparatus includes a processor and a memory configured to store computer readable instructions. When the computer readable instructions are executed by the processor, the alarm information processing apparatus is configured to perform:

a setting of a threshold about alarm information;

an accumulation of alarms occurring within a predetermined period of time; and a determination of whether the alarm information accumulated in the accumulation step exceeds the threshold set in the setting step.

According to the presently disclosed subject matter, a user such as a medical staff member can review a set value about a vital alarm, treatment on patients, replacement or improvement of attachment states of sensors etc., the number of medical staff members, etc. in order to suppress alarms. As a result, the number of times of occurrence of the alarms can decrease, and the alarm information processing apparatus can prevent a situation that the medical staff members are too busy to respond to usually occurring alarms, overlook any important alarm or get used to the alarms per se.

DETAILED DESCRIPTION OF EMBODIMENT

An embodiment of the presently disclosed subject matter will be described below with reference to the accompanying drawings. Incidentally, in description of the drawings, the same elements will be referred to by the same signs correspondingly and respectively, and duplicate description thereof will be omitted. In addition, dimensional ratios of the drawings may be changed for convenience of explanation to be different from real ratios.

Figure 1:
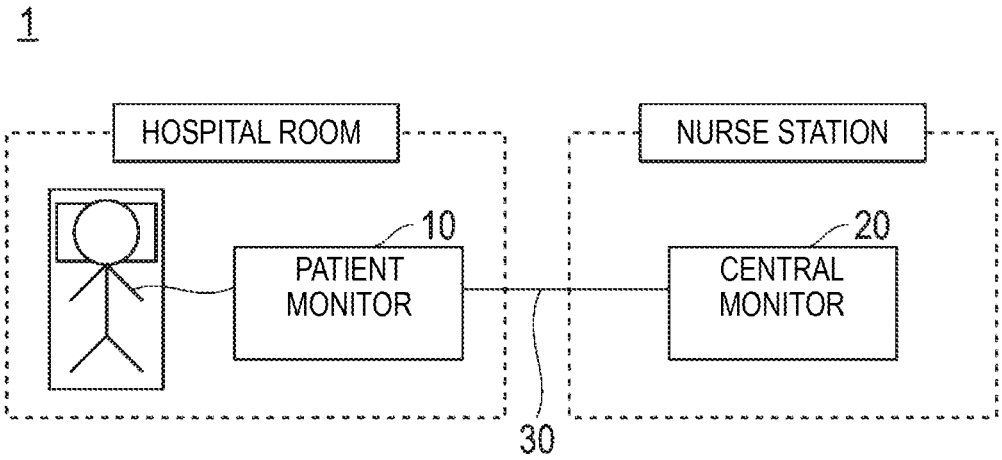
FIG. 1 illustrates a schematic configuration of a medical system according to an embodiment of the presently disclosed subject matter.

FIG. 1 is a diagram illustrating a schematic configuration of a medical system according to an exemplary embodiment of the presently disclosed subject matter.

As shown in FIG. 1, the medical system 1 is provided with one or more patient monitors 10, and a central monitor 20. The patient monitor(s) 10 and the central monitor 20 are connected communicably with each other through a network 30. The medical system 1 is, for example, installed in a facility such as a hospital.

Each of the patient monitors 10 is, for example, a bedside monitor installed in a hospital room for a patient. The patient monitor(s) 10 acquires and displays vital sign information of the patient, generates an alarm on a predetermined occasion, or transmits the acquired vital sign information to the central monitor 20.

The central monitor 20 serving as an alarm information processing apparatus is, for example, installed in a nurse station. The central monitor apparatus 20 displays the vital sign information of the patient received from the patient monitor 10, or instructs the patient monitor 10 to generate an alarm on the predetermined occasion.

Examples of the alarm generated by the patient monitor 10 and the central monitor 20 include a vital alarm, a technical alarm, etc. The vital alarm is an alarm for notification of abnormality of the vital sign information of the patient. The technical alarm is, for example, an alarm issued by the patient monitor apparatus 10 or the central monitor apparatus 20 etc. for notification of trouble of a measurement instrument, abnormality of an attachment state of a sensor (e.g. the sensor attached to the patient has come off), trouble of a measurement environment such as interruption of radio waves or mixture of noise, etc.

Next, the respective constituent elements will be described in detail.

Figure 2:
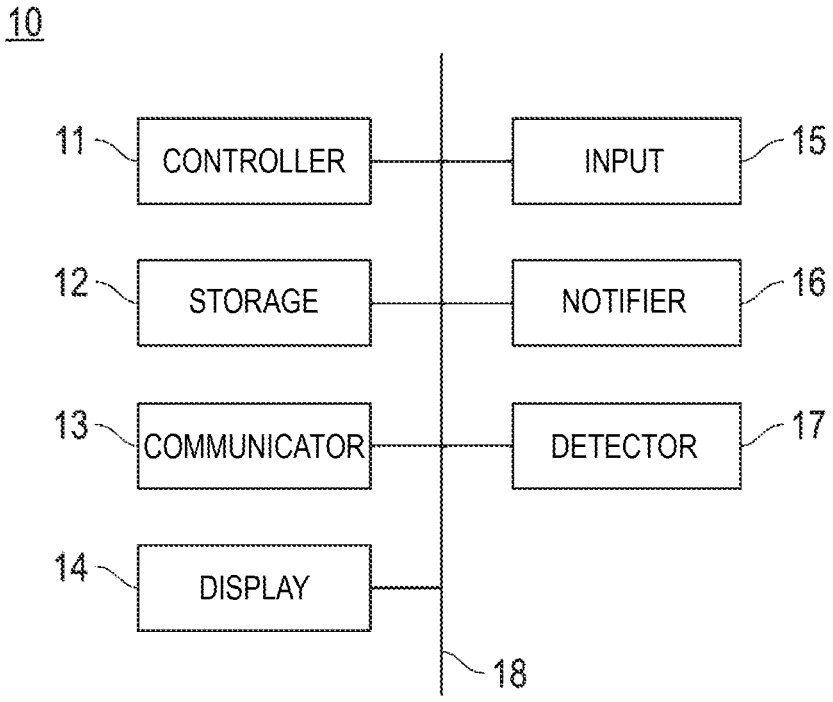
FIG. 2 is a block diagram illustrating a schematic configuration of a patient monitor.

FIG. 2 is a block diagram illustrating a schematic configuration of the patient monitor.

As shown in FIG. 2, the patient monitor 10 can include a controller 11, a storage 12, a communicator 13, a display 14, an input 15, a notifier 16, and a detector 17. The respective constituent elements are connected to one another through a bus 18 serving for exchanging signals.

The controller 11 is one or more CPU (Central Processing Unit) which executes control of the aforementioned respective constituent elements or various processing processes in accordance with a program.

The storage 12 is constituted by one or more ROM (Read Only Memory) storing various programs or various data in advance, one or more RAM (Random Access Memory) serving as a working area storing programs or data temporarily, one or more hard disk storing various programs or various data, etc.

The communicator 13 is an interface for making communication with another apparatus such as the central monitor 20.

The display 14 is constituted by a liquid crystal display, an organic EL display, a touch panel, or the like, which displays various information. For example, the display 14 displays the vital sign information of the patient, alarm information indicating contents of an alarm, etc.

The input 15 is constituted by a keyboard, a mouse, a touch panel, or the like, which accepts various inputs (operations) from a user.

The notifier 16 includes an audible notifier, e.g. a buzzer, a speaker, or the like, which generates an alarm sound, an operating sound, etc. In addition, the notifier 16 may include a visible notifier such as an indicator lit in various colors, or may light an indicator in a color according to importance of the alarm.

The detector 17 is a sensor which is attached to a body of the patient to detect vital sign information of the patient. For example, the detector 17 can include an electrode for measuring an ECG, a probe (SpO2 probe) for measuring blood oxygen saturation, etc. For example, the detector 17 detects an ECG signal, blood oxygen saturation, blood pressure values, a heart rate, a body temperature, etc. as the vital sign information. Incidentally, vital sign information of the patient may be detected by another measurement instrument (a transmitter etc.), and the patient monitor 10 may detect the vital sign information of the patient transmitted by the other measurement instrument. The vital sign information of the patient detected by the detector 17 or information about a technical alarm and a vital alarm is transmitted to the central monitor 20 through the communicator 13 etc.

Figure 3:
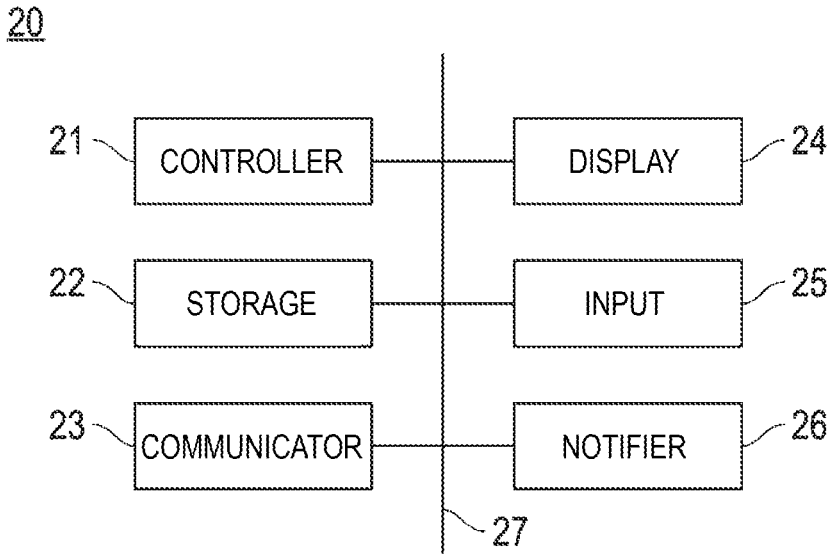
FIG. 3 is a block diagram illustrating a schematic configuration of a central monitor.

FIG. 3 is a block diagram illustrating a schematic configuration of the central monitor 20.

As shown in FIG. 3, the central monitor 20 can include a controller 21, a storage 22, a communicator 23, a display 24, an input 25, and a notifier 26. The respective constituent elements are connected to one another through a bus 27 serving for exchanging signals. Incidentally, the central monitor 20 is provided with the constituent elements similar to or the same as those of the patient monitor 10 except the detector 17. Therefore, detailed description about the respective constituent elements will be omitted.

Incidentally, the patient monitor 10 and the central monitor 20 may include any other constituent element than the aforementioned constituent elements or may exclude some constituent elements from the aforementioned constituent elements.

Successively, a functional configuration of the controller 21 of the central monitor 20 will be described.

Figure 4:
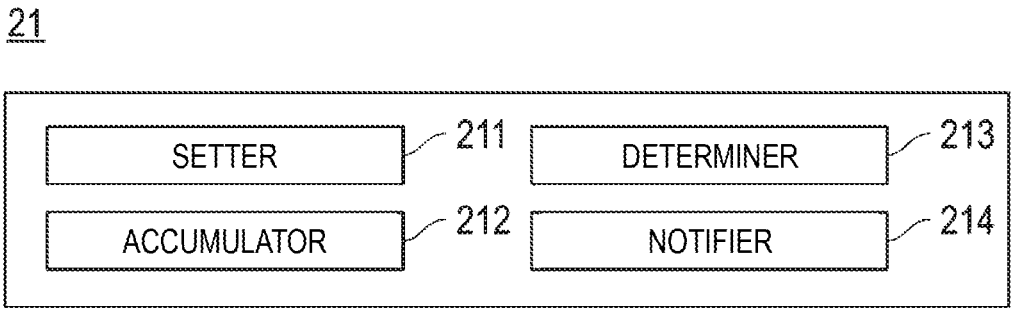
FIG. 4 is a block diagram illustrating a functional configuration of a controller of the central monitor.

FIG. 4 is a block diagram illustrating the functional configuration of the controller of the central monitor.

As shown in FIG. 4, the controller 21 reads a program and executes processing so as to function as a setter 211, an accumulator 212, a determiner 213, and a notifier 214.

The setter 211 sets a threshold about alarm information occurring within a predetermined period of time in the central monitor 20. For example, the predetermined period of time may be any desired period of time such as one hour or one day (24 hours).

The setter 211 sets a period of time and a threshold which are, for example, inputted by a user such as a medical staff member and accepted in the input 25, as the predetermined period of time and the threshold about the alarm information. In addition, the setter 211 may set the predetermined period of time automatically, and, at the same time, may acquire information about at least one of the number of medical staff members in a facility, the number of patients, a time slot and a day of the week, automatically calculate a threshold about the alarm information based on the information and set the calculated threshold. That is, the setter 211 can automatically set the threshold in consideration of the number of the medical staff members who can respond as soon as an alarm occurs, or the number of patients who are likely to cause alarms, etc. For example, when the number of the patients is larger, the setter 211 may set the threshold to be higher in accordance with an increase of alarms which may occur. In addition, when the number of the medical staff members is larger, the setter 211 may set the threshold to be higher in accordance with an increase of alarms to which the medical staff members can respond.

For example, the setter 211 sets a threshold about the number of times of occurrence of alarms, as the threshold about the alarm information. For example, the setter 211 may set 100 times as the threshold about the number of times of occurrence of alarms in one hour. Alternatively, the setter 211 may set 2,400 times as the threshold about the number of times of occurrence of alarms in one day.

In addition, the setter 211 may set a threshold about a duration time of alarms (a period of time in which each alarm occurs continuously) as the threshold about the alarm information. In the present embodiment, the "duration time of the alarms" includes (1) a duration time from when one alarm occurs until when the alarm ends, and (2) a duration time from when an first alarm occurs until when an second alarm ends in a case where the second alarm occurs during the occurrence of the first alarm.

Incidentally, as the threshold about the alarm information, the setter 211 may set one or both of the threshold about the number of times of occurrence of alarms and the threshold about the duration time of the alarms. In addition, the setter 211 may set a threshold about another desired item as the threshold about the alarm information.

The accumulator 212 accumulates alarms (information about the alarms) which have occurred within a predetermined period of time in the central monitor 20. For example, the accumulator 212 accumulates the number of times of occurrence of the alarms or the duration time of the alarms.

The determiner 213 determines whether the accumulated information about the alarms exceeds the threshold about the alarm information. For example, the determiner 213 determines whether the number of times of occurrence of the alarms within the predetermined period of time exceeds the threshold about the number of times of occurrence of the alarms. In addition, the controller 21 may determine whether the duration time of the alarms within the predetermined period of time exceeds the threshold about the duration time of the alarms.

The notifier 214 controls the respective constituent elements of the central monitor 20 on the predetermined occasion so as to notify the user such as the medical staff member. For example, the notifier 214 controls the display 24 to display a predetermined message so as to notify the user.

Next, a processing procedure of the central monitor 20 will be described with reference to FIG. 5.

Figure 5:
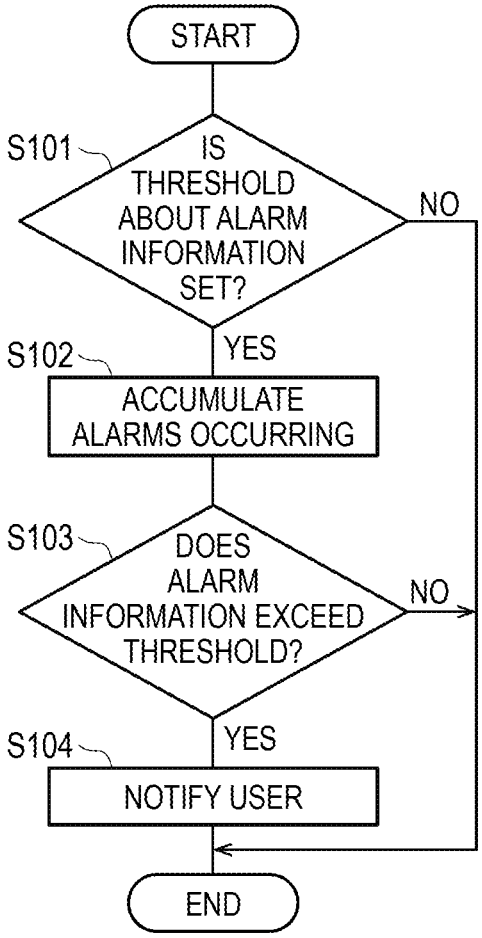
FIG. 5 is a flow chart illustrating a processing procedure of the central monitor.

FIG. 5 is a flow chart illustrating the processing procedure of the central monitor. An algorithm illustrated in the flow chart of FIG. 5 is stored as a program in the storage 22 of the central monitor 20 and executed by the controller 21.

As shown in FIG. 5, first, the controller 21 of the central monitor 20 functions as the setter 211 to check whether a threshold about alarm information within a predetermined period of time has been set (step S101). That is, the controller 21 checks whether a threshold about a number of times of occurrence of alarms, a threshold about a duration time of the alarms, or the like, which has been inputted by a user or set automatically is present.

When confirming that the threshold has been set (step S101: YES), the controller 21 functions as the accumulator 212 to accumulate alarms which have occurred within the predetermined period of time in the central monitor 20 (Step S102). The controller 21 accumulates the alarms within a period of time corresponding to the predetermined period of time set in association with the threshold about the alarm information. Incidentally, the controller 21 may accumulate the alarms for an item corresponding to the threshold about the alarm information which has been confirmed in the step S101. That is, the controller 21 may accumulate the number of times of occurrence of the alarms in the step S102 when, for example, confirming that the threshold about the number of times of occurrence of the alarms has been set in the step S101. Alternatively, the controller 21 may accumulate the duration time of the alarms in the step S102 when confirming that the threshold about the duration time of the alarms has been set in the step S101.

Successively, the controller 21 functions as the determiner 213 to determine whether the alarm information accumulated in the step S102 exceeds the threshold set in the step S101 (step S103). That is, for example, the controller 21 determines whether the number of times of occurrence of the alarms within the predetermined period of time exceeds the threshold about the number of times of occurrence of the alarms, or determines whether the duration time of the alarms within the predetermined period of time exceeds the threshold about the duration time of the alarms. Incidentally, in the case where both the threshold about the number of times of occurrence of the alarms and the threshold about the duration of the alarms have been set, the controller 21 may determine that the alarm information exceeds the threshold if one of the number of times of occurrence of the alarms and the duration time of the alarms exceeds a corresponding one of the thresholds.

When determining that the alarm information exceeds the threshold (step S103: YES), the controller 21 functions as the notifier 214 to notify the user (step S104). For example, the controller 21 may notify the user by displaying at least one of a message that the alarm information exceeds the threshold and a graph illustrating transition of an alarm occurrence status (the alarm information) on the display 24. Display contents in the display 24 will be described later with reference to FIG. 6 and FIG. 7. Then, the controller 21 terminates the processing.

When confirming that the threshold about the alarm information has not been set yet (step S101: NO) or when determining that the alarm information does not exceed the threshold (step S103: NO), the controller 21 terminates the processing.

Incidentally, the central monitor apparatus 20 may automatically execute the aforementioned process for each predetermined period of time set in association with the threshold about the alarm information.

Successively, the display contents of the central monitor apparatus 20 in the step S104 will be described.

Figure 6:
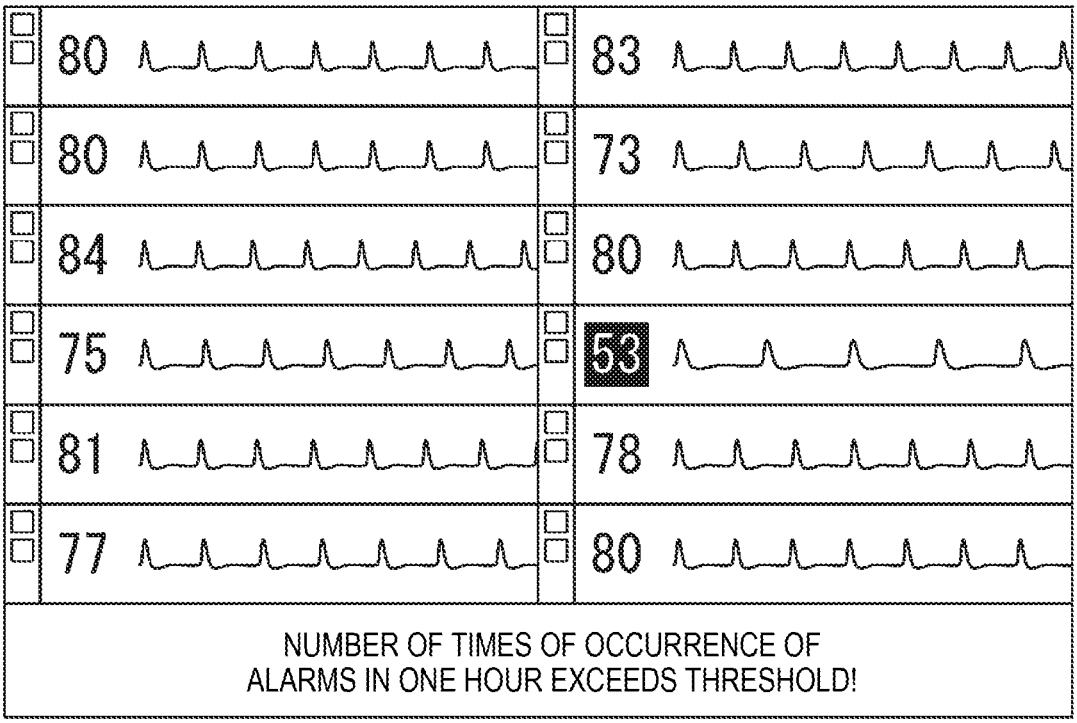
FIG. 6 explains display contents of the central monitor.
Figure 7:
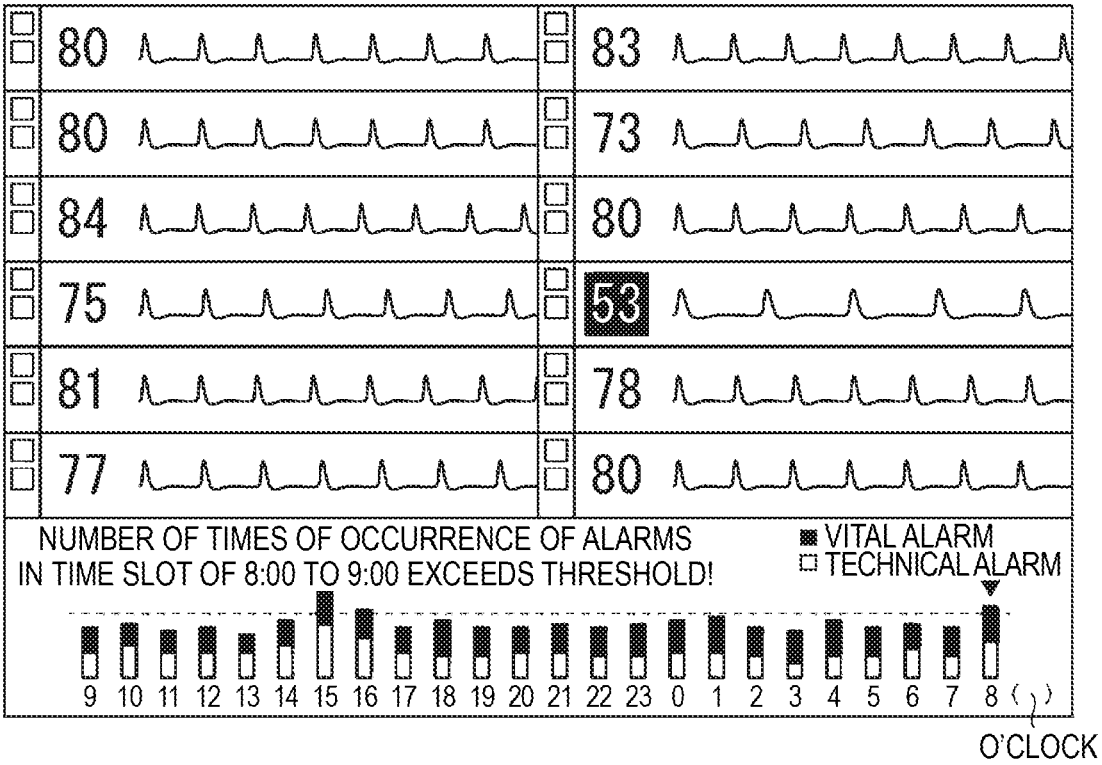
FIG. 7 explains display contents of the central monitor.

FIG. 6 and FIG. 7 illustrates the display contents of the central monitor.

As shown in FIG. 6, for example, the display 24 of the central monitor 20 displays a message that the alarm information within the predetermined period of time exceeds the threshold. In the example shown in FIG. 6, a message that a number of times of occurrence of alarms in the predetermined period of time, i.e. one hour exceeds the threshold is displayed on a lower side of a screen indicating vital sign information of respective patients. Thus, the central monitor 20 can notify the user of the fact that medical workers (medical staff members) are overloaded due to the usually occurring alarms.

In addition, as shown in FIG. 7, for example, the display 24 of the central monitor apparatus 20 may display a graph illustrating transition of an alarm occurrence status and a message that the alarm information within the predetermined period of time exceeds the threshold. In the example shown in FIG. 7, numbers of times of occurrence of alarms accumulated for each predetermined period of time, i.e. each hour of the past one day (24 hours) are displayed by a bar graph on a lower side of a screen illustrating vital sign information of respective patients. A number of times of occurrence of vital alarms and a number of times of occurrence of technical alarms are included in each of the numbers of times of occurrence of the alarms. The threshold about the number of times of occurrence of the alarms in one hour is displayed by a broken line, and a message that the number of times of occurrence of the alarms in a time slot of 8:00 to 9:00 which is a most recent time slot exceeds the threshold is displayed. Thus, the central monitor 20 can notify the user of the fact that the medical workers are overloaded and the trend of the time slot etc. in which the alarms occur usually.

In the example illustrated in FIG. 7, the central monitor apparatus 20 send out a notification to the user of the trend that each of a number of times of occurrence of alarms in a time slot of 8:00 to 9:00 and numbers of times of occurrence of alarms in time slots of 15:00 to 17:00 exceeds the threshold. Thus, the user such as a medical staff member can, for example, review treatment on the patients, replacement or improvement of attachment states of the sensors etc., the number of medical staff members etc. in the time slots. For example, there is a high possibility that the time slot of 8:00 to 9:00 is a time slot for wiping bodies of the patients, and the time slots of 15:00 to 17:00 are time slots corresponding to visiting hours between the patients and their families. Therefore, the medical staff members may preliminarily respond so as to prevent alarms from being caused by the patients in the time slots.

Incidentally, the display contents of the central monitor apparatus 20 are not limited to the examples illustrated in FIG. 6 and FIG. 7 but can be any contents if the user can be notified of the fact that the alarms occur usually. For example, the central monitor 20 may display a number of times of occurrence A of alarms or a duration time A of the alarms within a predetermined period of time and a threshold B about the number of times of occurrence of the alarms or the duration time of the alarms in a form of "A/B". In addition, the central monitor apparatus 20 may display, in real time, a graph illustrating transition of an alarm occurrence status in the lower portion of the screen indicating the vital sign information of the respective patients, and display a change about the alarm occurrence status as real time information in the graph.

As described above, the central monitor 20 serving as an alarm information processing apparatus determines whether the alarm information exceeds the threshold about the alarm information. Thus, the user such as the medical staff member can review a set value about the vital alarm, treatment on the patients, replacement or improvement of the attachment states of the sensors etc., the number of the medical staff members etc. in order to suppress the alarms. As a result, the number of times of occurrence of the alarms decreases, and the central monitor 20 can prevent a situation that the medical staff members are too busy to respond to the usually occurring alarms, overlook any important alarm, or get used to the alarms per se. Thus, the central monitor 20 can improve an environment where alarms occur usually.

In addition, the central monitor 20 may set a threshold about a number of times of occurrence of alarms as the threshold about the alarm information, and accumulate the number of times of occurrence of the alarms as the alarm information. Thus, the central monitor 20 can improve an environment where alarms occur usually, based on the number of times of occurrence of the alarms.

In addition, the central monitor 20 may set a threshold about a duration time of alarms as the threshold about the alarm information, and accumulate the duration time of the alarms as the alarm information. Thus, the central monitor 20 can improve an environment where alarms occur usually, based on the duration time of the alarms. In addition, assume that an alarm occurs continuously. In this case, even when the number of times of occurrence of the alarms does not exceed the threshold about the number of times but the duration time of the alarm exceeds the threshold about the duration time, the central monitor 20 can improve an environment where alarms occur usually.

In addition, the central monitor apparatus 20 may set the threshold about the alarm information, which is inputted by the user and accepted in the input 25. Thus, the central monitor 20 can set a proper threshold which has been inputted by the user to reflect situations, requests, etc. of medical sites. Accordingly, the central monitor 20 can improve an environment where alarms occur usually.

In addition, the central monitor 20 may automatically calculate the threshold about the alarm information based on information about at least one of the number of medical staff members, the number of patients, a time slot and a day of the week, and sets the calculated threshold. Thus, the central monitor 20 can automatically calculate and set a suitable threshold even without accepting any input of the threshold from the user. Accordingly, the central monitor apparatus 20 can improve an environment where alarms occur usually while reducing a burden on the user.

In addition, when determining that the alarm information exceeds the threshold about the alarm information, the central monitor 20 sends out a notification to the user. Thus, the central monitor 20 can notify the user of the fact that the medical staff members are overloaded due to the usually occurring alarms.

In addition, the central monitor 20 displays at least one of the message that the alarm information exceeds the threshold and the graph illustrating the transition of the alarm occurrence status. Thus, the central monitor 20 can provide specific information about the alarms to the user. Accordingly, the central monitor 20 can reduce the burden on the user who tries to suppress the alarms.

Incidentally, the presently disclosed subject matter is not limited to only the aforementioned embodiment but may be subjected to various changes, improvements, etc. within the scope of Claims.

For example, the case where the central monitor 20 sets the threshold about the alarm information in the central monitor 20 itself has been described by way of example in the aforementioned embodiment. However, the central monitor apparatus 20 may set an individual threshold for at least one patient. Thus, the central monitor 20 can individually determine alarm information for the patient etc. who causes alarms usually.

In addition, the case where the central monitor 20 makes determination about the number of times of occurrence of the alarms has been described by way of example in the aforementioned embodiment. However, the central monitor 20 may determine a number of times of occurrence of alarms according to each type of the alarms, as the number of times of occurrence of the alarms. That is, the central monitor 20 may, for example, set different thresholds for the vital alarm and the technical alarm or for more specific types of alarms, and determine whether the numbers of times of occurrence of the alarms exceed the thresholds for the types of the alarms respectively. Thus, the central monitor 20 can more effectively use the thresholds about the alarm information.

Alternatively, the central monitor 20 may perform weighting on the numbers of times of occurrence of the alarms in accordance with the types of the alarms respectively and determine whether a number of times of occurrence of the alarms obtained by the weighting exceeds a threshold. When, for example, it is grasped that more vital alarms occur than technical alarms in a certain environment, the central monitor 20 may set weighting on the number of times of occurrence of the vital alarms to be smaller than weighting on the number of times of occurrence of the technical alarms. Thus, the central monitor 20 can determine the alarm information more suitably in consideration of the different types of the alarms in a well-balanced manner.

In addition, the case where the central monitor 20 determines the alarm information in the central monitor 20 itself has been described by way of example in the aforementioned embodiment. However, the presently disclosed subject matter may be applied to the patient monitor 10. That is, the patient monitor 10 serving as an alarm information processing apparatus may execute the process shown in FIG. 5. When the patient monitor 10 is installed in a hospital room allocated to one patient, it is possible to prevent a situation that the user such as the medical staff member is too busy to respond to the alarms occurring usually about the patient, overlooks any important alarm or gets used to the alarms per se. In addition, each patient monitor 10 is used for each patient. Accordingly, it is possible to prevent a situation that, for example, the user such as the medical staff member may overlook an important alarm of one of patients buried in alarms occurring usually about another one of the patients. Incidentally, the patient monitor 10 may execute the process shown in FIG. 5, transmit information thereof to the central monitor apparatus, and display the transmitted information on the screen of the central monitor.

Alternatively, any other desired terminal serving as an alarm information processing apparatus may acquire alarm information from the patient monitor 10 or the central monitor 20 and execute the process shown in FIG. 5. The terminal may be a terminal such as a computer used by a leader of the medical staff members, a portable terminal carried by each of the medical staff members, or the like. Thus, any of the medical staff members who is not nearby the patient monitor 10 or the central monitor 20 can also confirm the alarm information.

In addition, as for the technical alarm such as electrode checking or interruption of radio waves, the duration time of the alarm may be set as a period of time in which the patient cannot be monitored.

Incidentally, the process in the central monitor 20 according to the aforementioned embodiment may include any other step than the steps of the aforementioned flow chart or may exclude some steps from the aforementioned steps. In addition, the sequence of the steps is not limited to the aforementioned embodiment. Further, each of the steps may be combined with another step and executed as one step, may be included in another step and executed, or may be separated into a plurality of steps and executed.

What is claimed is:

1. An alarm information processing apparatus comprising:

a setter that sets a threshold about alarm information;

an accumulator that accumulates alarms occurring within a predetermined period of time; and a determiner that determines whether the alarm information accumulated by the accumulator exceeds the threshold set by the setter, wherein:

the setter sets a threshold about a number of times of occurrence of the alarms for each type of the alarms included in the alarms, as the threshold about the alarm information; and the accumulator accumulates the number of times of occurrence of the alarms for each type of the alarms included in the alarms, as the alarm information.

2. The alarm information processing apparatus according to claim 1, wherein:

the setter sets a threshold about a duration time of the alarms as the threshold about the alarm information; and the accumulator accumulates the duration time of the alarms as the alarm information.

3. The alarm information processing apparatus according to claim 1, wherein:

the setter automatically calculates and sets the threshold about the alarm information based on information about at least one of a number of medical staff members, a number of patients, a time slot or a day of the week.

4. The alarm information processing apparatus according to claim 1, further comprising a notifier that sends out a notification to a user when it is determined by the determiner that the alarm information exceeds the threshold.

5. The alarm information processing apparatus according to claim 1, further comprising a display that displays at least one of a message that the alarm information exceeds the threshold or a graph illustrating transition of an occurrence status of the alarms.

6. An alarm information processing control method comprising:

setting a threshold about alarm information;

accumulating alarms occurring within a predetermined period of time; and determining whether the alarm information accumulated in the accumulation step exceeds the threshold set in the setting step, wherein:

the threshold about alarm information is a threshold about a number of times of occurrence of the alarms for each type of the alarms included in the alarms; and the accumulating step accumulates the number of times of occurrence of the alarms for each type of the alarms included in the alarms, as the alarm information.

7. The alarm information processing control method according to claim 6, wherein:

the setting step sets a threshold about a duration time of the alarms as the threshold about the alarm information; and the accumulating step accumulates the duration time of the alarms as the alarm information.

8. The alarm information processing control method according to claim 6, wherein:

the setting step automatically calculates and sets the threshold about the alarm information based on information about at least one of a number of medical staff members, a number of patients, a time slot or a day of the week.

9. The alarm information processing control method according to claim 6, further comprising:

sending out a notification to a user when it is determined that the alarm information exceeds the threshold.

10. The alarm information processing control method according to claim 6, further comprising:

displaying at least one of a message that the alarm information exceeds the threshold or a graph illustrating transition of an occurrence status of the alarms.

11. An alarm information processing apparatus comprising:

at least one processor; and at least one memory configured to store computer readable instructions, wherein when the computer readable instructions are executed by the at least one processor, the alarm information processing apparatus is configured to perform:

a setting of a threshold about alarm information;

an accumulation of alarms occurring within a predetermined period of time; and a determination of whether the alarm information accumulated in the accumulation step exceeds the threshold set in the setting step, wherein:

the threshold about alarm information is a threshold about a number of times of occurrence of the alarms for each type of the alarms included in the alarms; and the accumulating step accumulates the number of times of occurrence of the alarms for each type of the alarms included in the alarms, as the alarm information.

12. The alarm information processing apparatus according to claim 11, wherein:

the setting step sets a threshold about a duration time of the alarms as the threshold about the alarm information; and the accumulating step accumulates the duration time of the alarms as the alarm information.

13. The alarm information processing control method apparatus according to claim 11, wherein:

the setting step automatically calculates and sets the threshold about the alarm information based on information about at least one of a number of medical staff members, a number of patients, a time slot or a day of the week.

14. The alarm information processing control apparatus according to claim 11, wherein the alarm information processing apparatus is further configured to:

send out a notification to a user when it is determined that the alarm information exceeds the threshold.

15. The alarm information processing control apparatus according to claim 11, wherein the alarm information processing apparatus is further configured to:

display at least one of a message that the alarm information exceeds the threshold or a graph illustrating transition of an occurrence status of the alarms.

* * * * *